US006764170B2

(12) United States Patent
Ardito

(10) Patent No.: US 6,764,170 B2
(45) Date of Patent: Jul. 20, 2004

(54) REMOVABLE LABEL FOR SEALING AN INK-JET INK RESERVOIR

(75) Inventor: Michael S. Ardito, Lebanon, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 47 days.

(21) Appl. No.: 09/881,143

(22) Filed: Jun. 14, 2001

(65) Prior Publication Data

US 2002/0191056 A1 Dec. 19, 2002

(51) Int. Cl.[7] ..... B41J 2/175
(52) U.S. Cl. ..... 347/86
(58) Field of Search ..... 347/85–87; 206/205, 206/206, 461, 469, 497, 701

(56) References Cited

U.S. PATENT DOCUMENTS 5,131,539 A * 7/1992 Karita et al. ..... 206/462
5,701,995 A * 12/1997 Higuma et al. ..... 206/205
6,012,807 A * 1/2000 Olsen et al. ..... 347/85
6,164,769 A * 12/2000 Inada et al. ..... 347/86
6,241,348 B1 * 6/2001 Haigo ..... 347/86
6,390,291 B1 * 5/2002 Garrill et al. ..... 206/204

* cited by examiner

*Primary Examiner*—Michael Nghiem

(57) ABSTRACT

A package assembly for an ink-jet ink reservoir. The package assembly includes an ink-jet ink reservoir having a fluid orifice, a label removably and adhesively bonded to the reservoir and sealing the orifice, and pouch material bonded to the label and forming a package around the reservoir. In another aspect, the label has a lateral margin of deadened adhesive located at one end of the label insuring that when the pouch is removed from around the reservoir, the label is removed as well.

15 Claims, 5 Drawing Sheets

REMOVABLE LABEL FOR SEALING AN INK-JET INK RESERVOIR

BACKGROUND

The present invention generally relates to ink-jet ink delivery systems and, more particularly, to the packaging and moisture sealing of such systems.

On previous ink-jet print cartridges, prior to the cartridges being filled with ink, the nozzles were sealed by a tape and a card tab attachment located on the free end of the tape. Before installing the print cartridge in a printer, the tape was actively removed by the customer by pulling the tab. These were "active" designs in that they required the customer to recognize that there was a sealing tape that had to be removed and then to do so.

To prevent moisture loss during storage, previous print cartridges were also sealed with pouch film. Like the tab and tape, the pouch film was removed by the customer prior to installation of the print cartridge in the printer.

While these sealing techniques were satisfactory, there is a history of customers inserting print cartridges into printers without removing the tape that sealed the nozzles. This oversight caused some customer frustration when the printer did not operate but was easily solved by either removing the tape or replacing the print cartridge.

Recent improvements in ink-jet technology have resulted in the development of moving print heads, a stationary ink reservoir, and flexible fluid interconnects attached between the print heads and the ink reservoir. The stationary ink reservoir contains one or more inks of various hues. The flexible fluid interconnects attach to the ink reservoir at one or more fluid orifices; these orifices are sealed prior to filling the reservoir with ink.

On these newer systems it is possible to install a replacement ink reservoir in a printer without having removed the orifice seal. If the orifice seal is not removed, there is enough ink remaining in the the print head so that the printer can begin printing when commanded. The print head will soon exhaust the ink in the system and will fill up with air. Once the print head is filled with air, the printer will stop, the print head can not be refilled with ink, and the print head must be replaced. In a color printer, most likely all four costly print heads will need to be replaced. The result is a major warrantee expense to the manufacturer for this customer oversight.

It will be apparent from the foregoing that although there are many techniques for sealing ink-jet ink delivery systems, there is still a need for a simple approach that insures that the seals are removed from the system by the customer prior to installation of the product in a printer.

SUMMARY

Briefly and in general terms, a package assembly for an ink-jet ink reservoir according to the invention includes an ink-jet ink reservoir having a fluid orifice, a label removably and adhesively bonded to the reservoir that seals the orifice, and pouch material bonded to the label, forming a package around the reservoir.

Another aspect of the invention is a laminate label having a layer of adhesive, removably bondable to an ink-jet ink reservoir; a layer of polyester film on one side of which the adhesive layer is coated; a layer of laminating film on the other side of the polyester film; a layer of aluminum foil, one side of the aluminum foil being bonded to the polyester film by the laminating film; a layer of laminating adhesive; and a polyethylene heat seal film, the other side of the aluminum foil being bonded to the heat seal film by said laminating adhesive.

In operation, the invention contemplates removing a label from an ink-jet ink reservoir by removing a pouch that contains the reservoir, raising one end of the label from the reservoir by removing the pouch, applying a shear force between the pouch and the label, and applying a tension force between the label and the reservoir.

Other aspects and advantages of the invention will become apparent from the following detailed description, taken in conjunction with the accompanying drawings, illustrating by way of example the principles of the invention.

DETAILED DESCRIPTION

Figure 1:
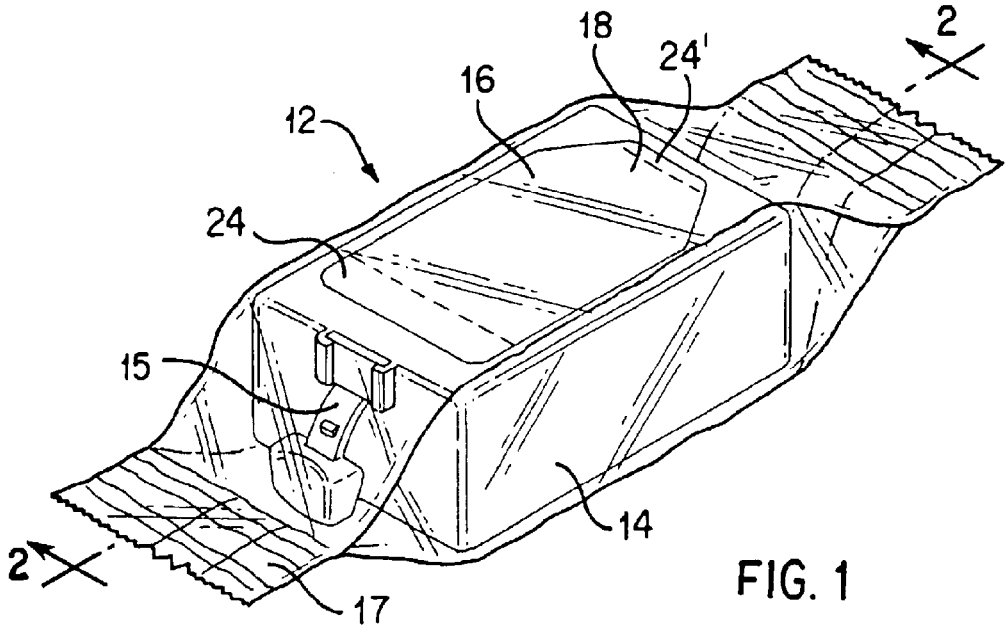
FIG. 1 is a perspective view of a package assembly embodying the principles of the invention.

As shown in the drawings for the purposes of illustration, the invention is embodied in a removable label that seals the ink orifices on an ink-jet ink reservoir and that is bonded to the pouch material that forms a package around the reservoir. When the pouch material is removed from around the reservoir by a customer prior to installing the reservoir in a printer, the pouch material pulls off the label as well because the pouch material is securely bonded to the label. The invention seeks to make removal of the sealing label automatic by leveraging the "mental model" that the customer has regarding packaging materials. Customers are conditioned to remove pouch materials and proceed to do so when confronted with a film enclosed pouch that surrounds the product that the customer wishes to use. In the process of pouch removal, the sealing label is simultaneously removed and the reservoir is ready for installation in a printer. This process of label removal is a "passive" approach since "active" customer recognition and action to remove the label is not required.

Referring to FIG. 1, reference numeral 12 generally indicates a package assembly for an ink-jet ink reservoir. The assembly includes an ink reservoir 14 that has a latch 15 at one end for installing and retaining the reservoir 14 in a printer (not shown). On the top wall of the reservoir is a label 16 that seals the reservoir 14 just prior to ink filling and that remains in place until the package assembly 12 is opened by the customer for installation of the reservoir in a printer. The function of the label is to seal the reservoir during ink filling, to contain the ink in the reservoir during storage and delivery to the customer, and to prevent evaporative loss of the volatile components in the ink before installation. The reservoir 14, latch 15, and label 16 are contained in a pouch 17 that is formed around the reservoir, completing the package assembly 12.

Figure 7:
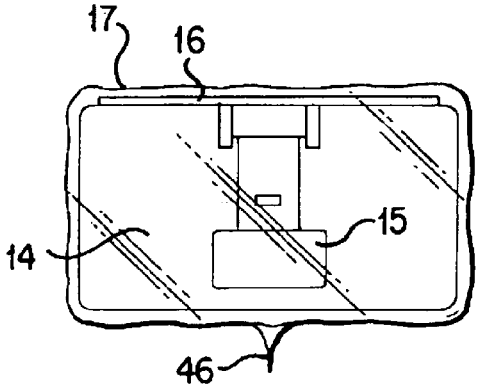

Referring to FIG. 1, the pouch 17 is fabricated from clear, polypropylene film. The pouch is sealed at both ends and, along the longitudinal axis of the reservoir 14 on the side opposite from the label 16, as illustrated in FIG. 7. The pouch 17 is sealed along the longitudinal axis of the reservoir on the side opposite from the label 16 so that the customer can tear the pouch along that seam first, allowing for easy gripping of the reservoir while the label 16 and the pouch are being removed. This seam is also placed opposite the label so it does not interfere with the heat staking of pouch to the label. The main function of the pouch is to serve as that part of the package assembly 12 that the customer grasps, pulls open, and removes, thereby also removing the label from the reservoir 14.

Figure 2:
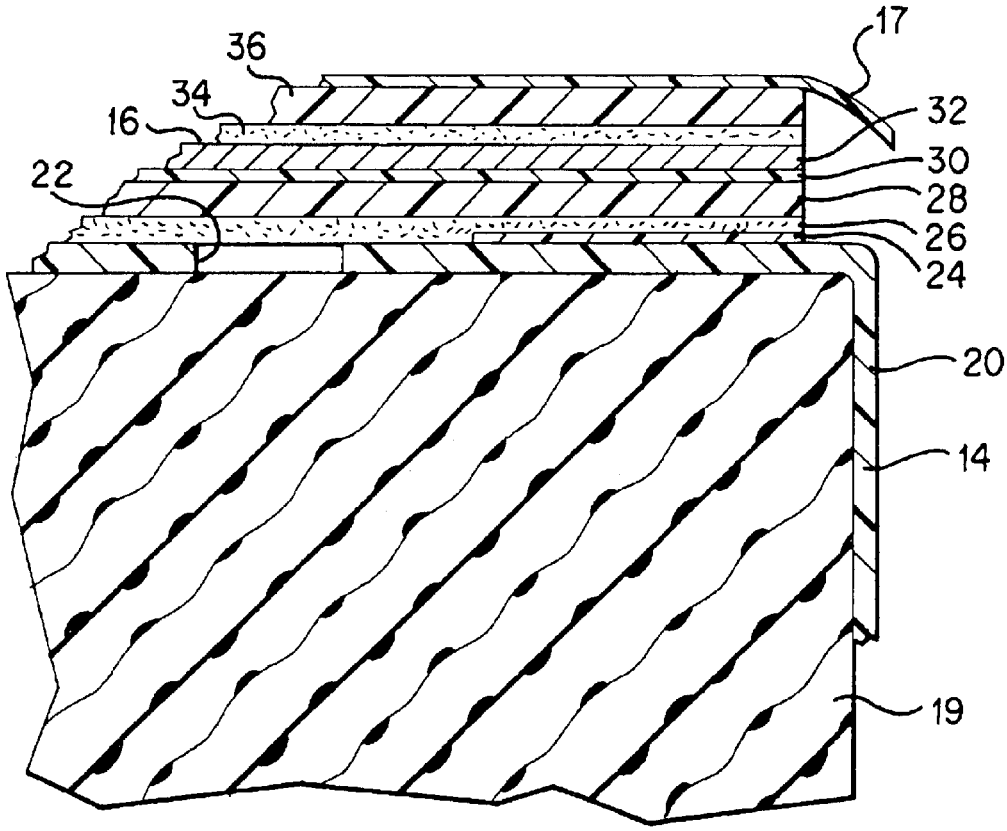
FIG. 2 is a side elevation view, partially cut away and in cross section taken along line 2—2 of FIG. 1 of the package assembly of FIG. 1.
Figure 3:
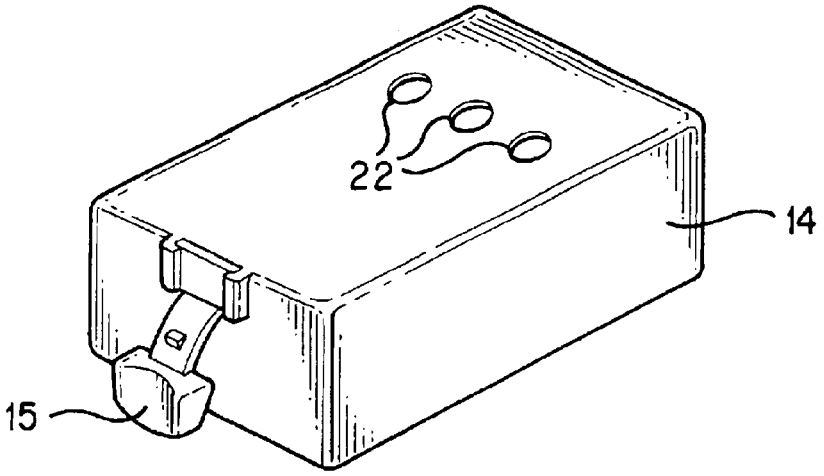
FIG. 3 is a perspective view of the ink reservoir of FIG. 1.

Referring to FIG. 2, within the reservoir 14 is bonded polymer fiber (BPF) that is the capillary reservoir material that holds the ink in the reservoir after installation in a printer at a pressure at which the ink will not run out of the reservoir but can be drawn out by the operation of the print head (not shown). The BPF and the ink are contained in the reservoir 14 by a reservoir wall 20 which is fabricated from injected molded polypropylene. In the top wall 20, as illustrated in FIG. 2, is a fluid interconnect orifice 22. (When the reservoir is installed in a printer, this orifice is on the bottom, upside down from FIG. 2.) To seal the reservoir 14, the label 16, FIG. 1, seals the fluid interconnect orifice 22, FIG. 2. In FIG. 3 three interconnect orifices are illustrated; this is a reservoir for a color printer that contains three inks of different hues. For a reservoir that contains only black ink, there is only one fluid interconnect orifice. Each orifice has a diameter of about 5/16's of an inch. When the reservoir is installed in a printer, the fluid interconnects are received in the fluid interconnect orifices. During operation of the printer, ink flows out of the reservoir 14, through the fluid interconnect orifice 22, into a fluid interconnect (not shown) and onto the print head (not shown).

Referring to FIGS. 1 and 2, reference numerals 24, 24' generally indicate two lateral margins of deadened adhesive located at the ends of the label 16. The deadened adhesive is preferably formed by a very thin film of polyester that creates a zone or region in which the label does not adhesively bond to the reservoir 14. The margins can also be created by applying a varnish to the adhesive to remove the tackiness from the adhesive layer 26. During removal of the reservoir from the pouch 17, the presence of the deadened adhesive subjects the bond between the pouch and the label to a shear force and the bond between the label and the reservoir to a tension force, both forces being created by the removal of the reservoir from the pouch. The margins of deadened adhesive thereby aid the reliable removal of the label from the reservoir.

Referring to FIG. 2, reference numeral 26 indicates a layer of removable adhesive. This adhesive is silicone based, pressure sensitive, and removably bondable to the reservoir 14. This layer 26 affixes the label 16 to the reservoir, seals the fluid interconnect orifice(s) 22, and allows the label to be removed from the reservoir prior to installation of the reservoir in a printer (not shown).

In FIG. 2, reference numeral 28 indicates a carrier film onto which the removable adhesive 26 is coated. The carrier film is polyester and provides a surface onto which the adhesive layer 26 can reliably adhere. In other words, when the label 16 is removed from the reservoir 14, all of the adhesive 26 remains on the label/carrier film 28, and no adhesive is left behind on the reservoir.

In FIG. 2 reference numeral 30 indicates a layer of laminating film, and reference 32, a layer of aluminum foil. The laminating film 30 is a thermoset, plastic film that bonds the aluminum foil to the carrier film 28. The function of the aluminum foil is to prevent moisture transmission of the ink in the reservoir 14 through the label by diffusion.

In FIG. 2 reference numeral 34 indicates a layer of laminating adhesive and reference 36, a heat seal film. The laminating adhesive 34 is a pressure sensitive, synthetic rubber based adhesive that bonds the aluminum foil 32 to the heat seal film 36. The heat seal film 36 is a co-extruded, polyethylene, two layer laminate. The layer nearer the aluminum foil 32 is a high-density polyethylene that serves as a carrier for a layer of very low-density polyethylene located nearer the pouch 17. The low-density polyethylene is chosen to melt readily at low temperatures, preferably below 150° C., and at moderate pressure when the pouch 17 is heat staked to the heat seal film 36.

FIGS. 3–9 are diagrammatic views illustrating the process for applying the removable label to the reservoir and forming the pouch around the reservoir.

FIG. 3 illustrates the reservoir 14 before the label is applied and the pouch is formed. This is a three chamber reservoir with three fluid interconnect orifices 22.

Figure 4:
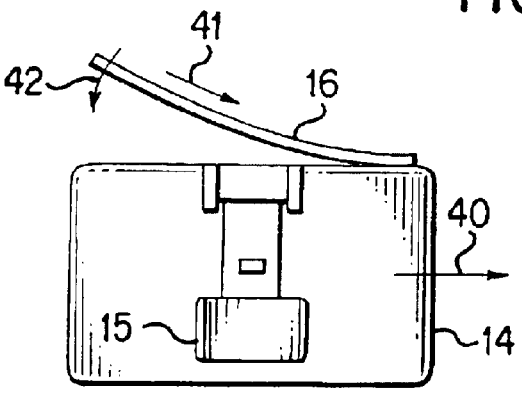
FIGS. 4–9 are diagrammatic views illustrating the process for applying a removable label and forming the package assembly of FIG. 1.

FIG. 4 illustrates the application of the label 16 on the reservoir 14. The reservoir is moving horizontally as indicated by the arrow 40. The label 16 is moving forward as indicated by the arrow 41 and moving downward as indicated by the arrow 42. In other words, the label and the reservoir are moving in such a way as to merge together.

Figure 5:
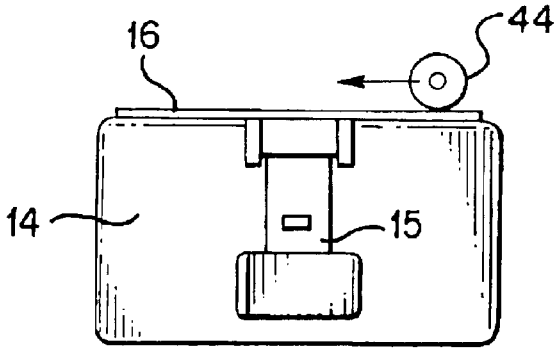
Figure 6:
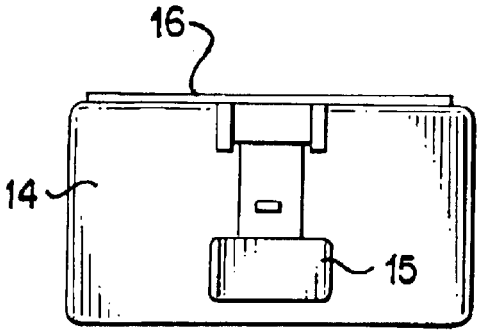

In FIG. 5, a pressurized roller 44 with a soft rubber surface is rolled across the label 16. The adhesive layer 26, FIG. 2, is pressure sensitive and the roller 44 insures that the label bonds to the reservoir. FIG. 6 illustrates the label 16 in place on the reservoir 14. The label fluidically blocks the three fluid interconnect orifices 22, FIG. 3. In the next process step, not illustrated, the reservoir is then filled with ink.

Figure 8:
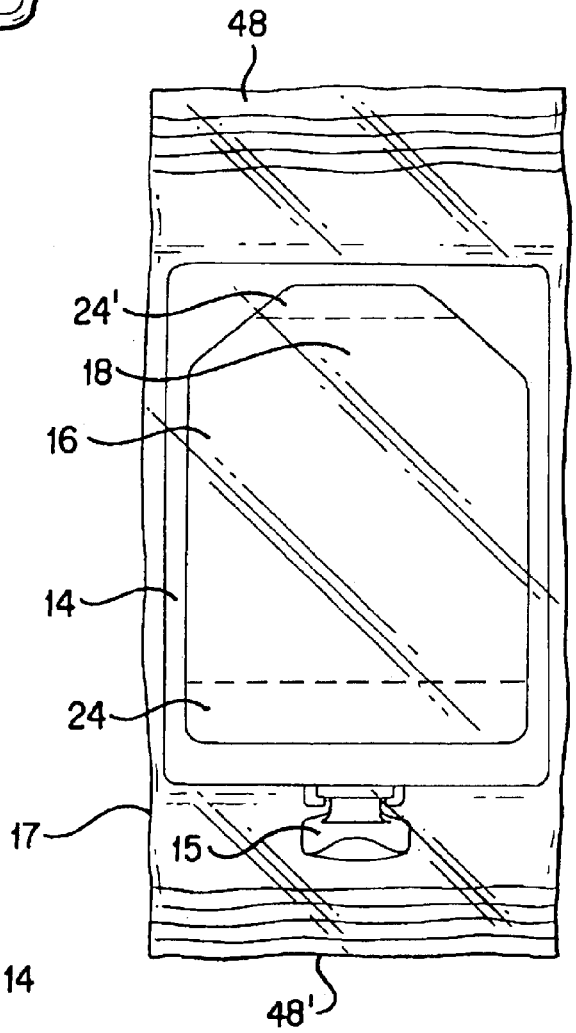

FIG. 7 illustrates the beginning of the pouching process. The reservoir 14 is enveloped in a cylinder of transparent pouch film 17. The two ends of the pouch film are brought together and heat staked to form a longitudinal seal 46. For ease of opening the pouch, the longitudinal seal 46 is located on the side of the reservoir 14 opposite to the label 16. In FIG. 8 the pouching process is completed by heat staking the longitudinal ends of the pouch 17 together to form the end seals 48.

Figure 9:
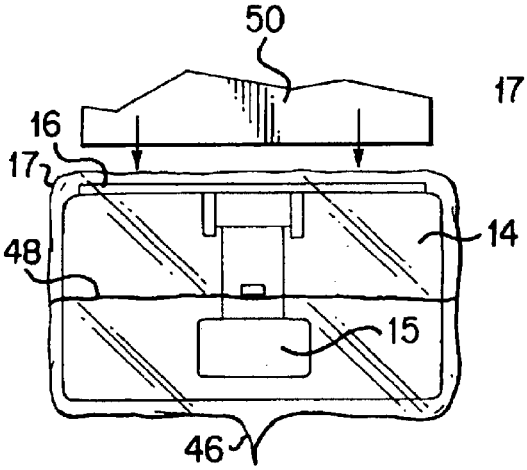

In FIG. 9 the newly formed pouch 17 is heat staked to the label 16 with a heated stake head 50. The stake head presses down on the pouch 17, heats it, and in turn presses the pouch down onto the heat seal film 36, FIG. 2, thereby bonding the pouch 17 to the label 16/heat seal film 36. The adhesive bonding strength between the label 17 and the pouch 17 is much greater than the adhesive bonding strength between the label 17 and the reservoir 14 so that when the reservoir is removed from the pouch, the pouch and label remain adhesively bonded together and the label is pulled off of the reservoir by the motion of the pouch. The product is now assembled.

Figure 10:
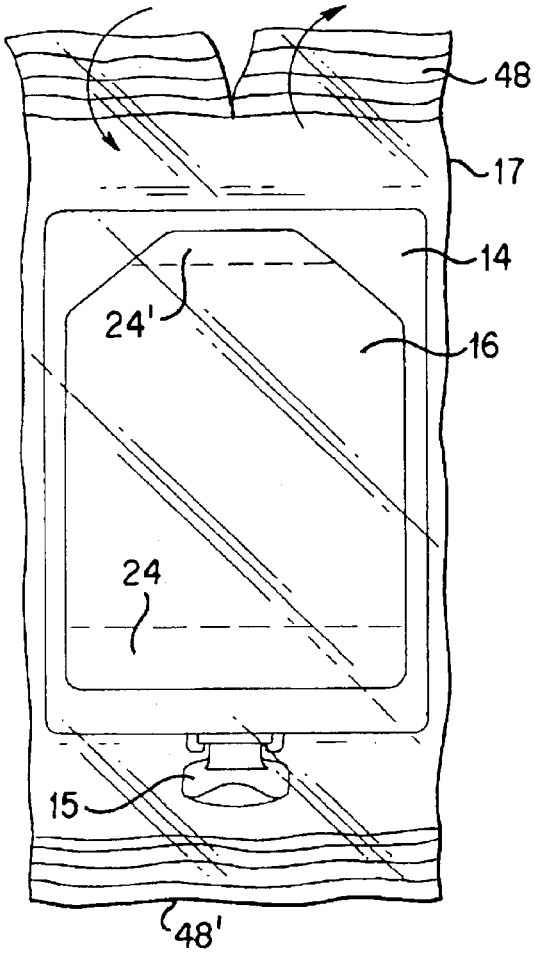
FIG. 10 is a diagrammatic view illustrating the opening of the package assembly of FIG. 1.

There are various ways that a customer can open the pouch 17 in order to gain access to the reservoir. FIG. 10 illustrates a typical way that customers open the product. That is, one of the end seals 48 is grasped and the pouch 17 is torn lengthwise down the middle.

Figure 11:
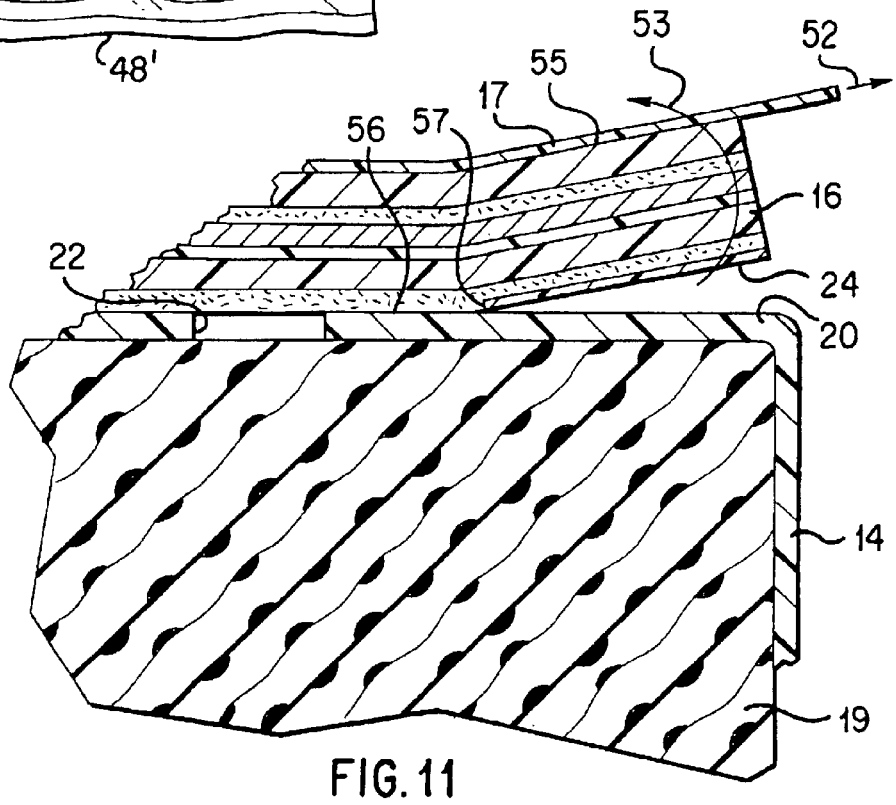
FIG. 11 is a side elevation view, partially cut away and in cross section taken along line 2—2 of FIG. 1, of the package assembly of FIG. 1, illustrating removal of the label from the reservoir.

Referring to FIG. 11, as the pouch film 17 is being removed from around the reservoir 14, the customer exerts a force on the label 16 by way of the pouch film. This force is indicated by arrow 52. The force 52 causes the zones 24 of deadened adhesive to immediately lift up since these zones are not bonded to the reservoir wall 20. This lifting motion is indicated by the arrow 53. As can be seen in FIG. 11, the force 52 subjects the heat stake joint 55 between the pouch 17 and the label 16 to a shear force. In contrast, the force 52 subjects the adhesive joint 56 between the label 16 and the reservoir wall 20 to a tension force at the apex 57 of the opening.

Figure 12:
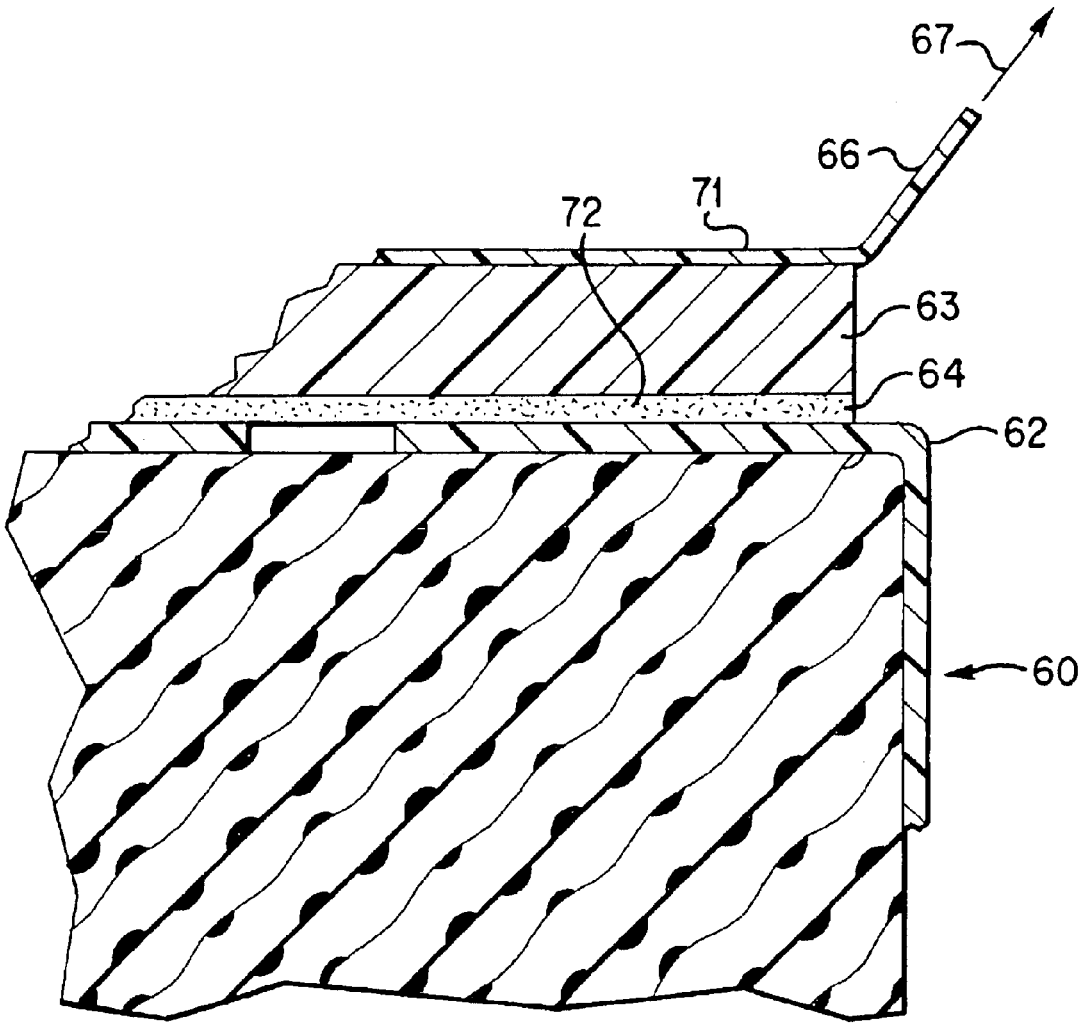
FIG. 12 is a side elevation view, partially cut away and in cross section of a label without regions of deadened adhesive, illustrating removal of the label from a reservoir.

FIG. 12 illustrates the removal of a pouch 66 from around a reservoir 60 when there are no deadened zones of adhesive. The label 63 has an adhesive layer 64 that adhesively bonds to a reservoir wall 62 but no deadened zones of adhesive. The reservoir 60, label 63 and pouch 66 are fabricated in the same manner as described above. The pouch 66 and label 63 are removed from the reservoir 60 by a force 67 exerted on the label by the customer by way of the pouch film 66. As can be seen in FIG. 12, the force 67 subjects the heat stake joint 71 between the pouch 66 and label 63 to a tension force and the adhesive joint 72 between the label 63 and the reservoir wall 62 to a tension force as well.

The heat stake joint between the pouch and the label is much stronger in shear than in tension and, when principally loaded by a shear force, is far less likely to fail before the adhesive joint fails and releases the label from the reservoir. In addition, the deadened zones of adhesive create a preferential peel front at the apex 57. Thus, deadening the adhesive joint at the lateral margins of the label dramatically increases the reliability of the label removal operation overall.

Although specific embodiments of the invention have been described and illustrated, the invention is not to be limited to the specific forms or arrangement of parts so described and illustrated. The invention is limited only by the claims.

What is claimed is:

1. A package assembly, comprising:

an ink-jet reservoir having a fluid orifice;

packaging material sealed to enclose the ink-jet reservoir; and a sealing member having a bottom side with a bonding region bonded to the reservoir and sealing the orifice and an edge region facing and overlying the reservoir and being unattached to the reservoir, and a top side including a region bonded to the packaging material and overlying the unattached edge region of the bottom side of the sealing member;

wherein the packaging material is clear and the sealing member includes a label configured to be read through the packaging material.

2. The package assembly of claim 1, wherein the unattached bottom side edge region of the sealing member includes a lateral margin of deadened adhesive.

3. The package assembly of claim 2, wherein the margin of deadened adhesive forms a preferential peeling front between the sealing member and the reservoir.

4. The package assembly of claim 1, wherein bonding strength between the sealing member top side and the packaging material is greater than bonding strength between the bonding region of the sealing member bottom side and the reservoir.

5. A removable label for sealing an ink jet ink reservoir, comprising:

a laminate label having a layer of adhesive removably bondable to the ink jet ink reservoir, a layer of polyester film on one side of which the adhesive layer is coated, a layer of laminating film on the other side of the polyester film, a layer of aluminum foil, one side of the aluminum foil being bonded to the polyester film by the laminating film, a layer of laminating adhesive, and a polyethylene heat seal film, the other side of the aluminum foil being bonded to the heat seal film by said laminating adhesive.

6. The removable label of claim 5 further including a lateral margin of deadened adhesive located at one end of the label.

7. The removable label of claim 6 wherein the lateral margin is a layer of polyester located between the reservoir and the layer of removable adhesive.

8. A package assembly, comprising:

an ink-jet reservoir having a fluid orifice;

packaging material sealed to enclose the ink-jet reservoir; and a sealing member having a bottom side with a bonding region bonded to the reservoir and sealing the orifice and an edge region facing and overlying the reservoir and being unattached to the reservoir, and a top side including a region bonded to the packaging material and overlying the unattached edge region of the bottom side of the sealing member, wherein the unattached bottom side edge region of the sealing member includes a lateral margin of deadened adhesive, wherein the deadened adhesive is a layer of polyester located between the sealing member and the reservoir.

9. A package assembly, comprising:

an ink-jet reservoir having a fluid orifice;

packaging material sealed to enclose the ink-jet reservoir; and a sealing member haying a bottom side with a bonding region bonded to the reservoir and sealing the orifice and an edge region facing and overlying the reservoir and being unattached to the reservoir, and a top side including a region bonded to the packaging material and overlying the unattached edge region of the bottom side of the sealing member, wherein the unattached bottom side edge region of the sealing member includes a lateral margin of deadened adhesive, wherein the deadened adhesive is a layer of material that reduces bonding of the edge region of the sealing member to the reservoir.

10. A package assembly, comprising:

an ink-jet reservoir having a fluid orifice;

packaging material sealed to enclose the ink-jet reservoir; and a sealing member having a bottom side with a bonding region bonded to the reservoir and sealing the orifice and an edge region facing and overlying the reservoir and being unattached to the reservoir, and a top side including a region bonded to the packaging material and overlying the unattached edge region of the bottom side of the sealing member, wherein all regions of the bottom side of the sealing member face and overlie a wall of the reservoir.

11. A package assembly, comprising:

an ink-jet reservoir having a fluid orifice;

packaging material sealed to enclose the ink-jet reservoir; and a sealing member having a bottom side with a bonding region bonded to the reservoir and sealing the orifice and an edge region facing and overlying the reservoir and being unattached to the reservoir, and a top side including a region bonded to the packaging material and overlying the unattached edge region of the bottom side of the sealing member, wherein a major portion of the top side of the sealing member is bonded to the packaging material.

12. A package assembly, comprising:

an ink-jet reservoir having a fluid orifice;

packaging material sealed to enclose the ink-jet reservoir; and a sealing member having a bottom side with a bonding region bonded to the reservoir and sealing the orifice and an edge region facing and overlying the reservoir and being unattached to the reservoir, and a top side including a region bonded to the packaging material and overlying the unattached edge region of the bottom side of the sealing member, wherein the packaging material includes an end with a seam oriented substantially parallel to the bonding region of the bottom side of the sealing member.

13. The package assembly of claim 12, wherein the packaging material includes a second end with a second seam oriented substantially parallel to the bonding region of the bottom side of the sealing member.

14. The package assembly of claim 13, wherein the bonded region of the sealing member top side is bonded to a region of packaging material separate from the first and second seams.

15. A package assembly, comprising:

an ink-jet reservoir having a fluid orifice;

packaging material sealed to enclose the ink-jet reservoir; and a sealing member haying a bottom side with a bonding region bonded to the reservoir and sealing the orifice and an edge region facing and overlying the reservoir and being unattached to the reservoir, and a ton side including a region bonded to the packaging material and overlying the unattached edge region of the bottom side of the sealing member, wherein the sealing member includes a layer of aluminum foil.

* * * * *